US009583290B2

(12) United States Patent
Horiguchi et al.

(10) Patent No.: US 9,583,290 B2
(45) Date of Patent: Feb. 28, 2017

(54) SOLENOID DEVICE

(71) Applicants: NIPPON SOKEN, INC., Nishio, Aichi-pref. (JP); ANDEN CO., LTD., Anjo, Aichi-pref. (JP)

(72) Inventors: Masakatsu Horiguchi, Obu (JP); Ken Tanaka, Okazaki (JP); Tomoaki Tanaka, Okazaki (JP); Takashi Ito, Nagoya (JP)

(73) Assignees: NIPPON SOKEN, INC., Nishio (JP); ANDEN CO., LTD., Anjo (JP)

( * ) Notice: Subject to any disclaimer, the term of this patent is extended or adjusted under 35 U.S.C. 154(b) by 0 days.

(21) Appl. No.: 14/455,485

(22) Filed: Aug. 8, 2014

(65) Prior Publication Data

US 2015/0042422 A1 Feb. 12, 2015

(30) Foreign Application Priority Data

Aug. 8, 2013 (JP) ..... 2013-165396

(51) Int. Cl.

| | |
|---|---|
| ***H01H 67/06*** | (2006.01) |
| ***H01H 50/22*** | (2006.01) |
| ***H01H 50/54*** | (2006.01) |
| *H01H 50/36* | (2006.01) |

(52) U.S. Cl.

CPC ..... *H01H 50/22* (2013.01); *H01H 50/54* (2013.01); *H01H 2050/362* (2013.01); *H01H 2235/01* (2013.01)

(58) Field of Classification Search

CPC ..... H01H 47/00; H01H 50/36; H01H 51/20; H01F 7/1607

USPC ..... 335/127

See application file for complete search history.

(56) References Cited

U.S. PATENT DOCUMENTS

| | | | | | |
|---|---|---|---|---|---|
| 269,453 | A | * | 12/1882 | Parker | H05B 31/0081 314/109 |
| 731,741 | A | * | 6/1903 | Baxter, Jr. | H01H 51/20 335/185 |
| 946,215 | A | * | 1/1910 | Geissinger | F02D 41/20 251/129.01 |
| 2,138,275 | A | * | 11/1938 | Heinrich | H01H 9/40 200/5 R |
| 2,528,777 | A | * | 11/1950 | Persons | H01H 50/323 335/259 |

(Continued)

FOREIGN PATENT DOCUMENTS

| | | |
|---|---|---|
| JP | S57-89247 | 6/1982 |
| JP | 2010-212035 | 9/2010 |

(Continued)

*Primary Examiner* — Shawki S Ismail
*Assistant Examiner* — Lisa Homza
(74) *Attorney, Agent, or Firm* — Nixon & Vanderhye P.C.

(57) ABSTRACT

A solenoid device includes at least one electromagnetic coil for generating a magnetic flux when energized, a fixed core constituting part of a magnetic circuit through which the magnetic flux passes, and plungers constituting the magnetic circuit together with the fixed core and configured to advance to and retract from the fixed core depending on whether the magnetic coil is energized or de-energized. The magnetic circuit is provided with a magnetic resistance part as a resistance for the magnetic flux. The plungers are configured to be attracted to the fixed core by energizing the electromagnetic coil.

6 Claims, 18 Drawing Sheets

(56) References Cited

U.S. PATENT DOCUMENTS

| | | | | |
|---|---|---|---|---|
| 7,535,328 | B2 * | 5/2009 | Kurasawa | H01H 50/305 310/14 |
| 7,557,684 | B2 * | 7/2009 | Kurasawa | H01H 50/36 335/126 |
| 8,143,979 | B2 * | 3/2012 | Usami | H01H 50/14 335/127 |
| 8,400,243 | B2 * | 3/2013 | Okada | F02N 11/087 335/259 |
| 8,669,835 | B2 * | 3/2014 | Hrnjak | F02N 11/087 335/126 |
| 2010/0207713 | A1 * | 8/2010 | Sugisawa | H01H 50/54 335/192 |
| 2013/0063231 | A1 * | 3/2013 | Tomimbang | H01H 50/32 335/127 |
| 2013/0207750 | A1 * | 8/2013 | Daitoku | H01H 50/00 335/126 |
| 2013/0222089 | A1 * | 8/2013 | Daitoku | H01F 7/081 335/259 |
| 2014/0176267 | A1 * | 6/2014 | Hirabayashi | H01H 50/54 335/127 |
| 2014/0225691 | A1 * | 8/2014 | Tanaka | H01F 7/1638 335/267 |
| 2015/0042422 | A1 * | 2/2015 | Horiguchi | H01H 50/22 335/127 |

FOREIGN PATENT DOCUMENTS

| | | | | |
|---|---|---|---|---|
| JP | 2010-287455 | | 12/2010 | |
| JP | 2010287455 | A * | 12/2010 | H01H 50/36 |
| JP | 2013-179243 | | 9/2013 | |
| JP | 2013-211514 | | 10/2013 | |

* cited by examiner

SOLENOID DEVICE

This application claims priority to Japanese Patent Application No. 2013-165396 filed on Aug. 8, 2013, the entire contents of which are hereby incorporated by reference.

BACKGROUND OF THE INVENTION

1. Field of the Invention

The present invention relates to a solenoid device including a plurality of plungers.

2. Description of Related Art

Japanese Patent Application Laid-open No. 2010-287455 describes a solenoid device including a plurality of electromagnetic coils, a plurality of plungers and a fixed core. This solenoid device is configured to generate magnetic force to attract one of the plungers to the fixed core by energizing a corresponding one of the electromagnetic coils. Between each plunger and the fixed core, a spring member is disposed. When the electromagnetic coil is de-energized, the magnetic force is decreased, as a result of which the corresponding plunger is moved away from the fixed core by the elastic force of the spring member.

As explained above, in this solenoid device, any one of the plurality of the plungers can be moved relative to the fixed core by controlling energization of a corresponding one of the solenoids.

However, to maintain the multi-attracting state (the state where the plurality of the plungers are attracted to the fixed core concurrently), the energization has to be maintained for each of the electromagnetic coils. Accordingly, the above solenoid device has a problem in that when the multi-attracting state has to be maintained for a long time, electric power consumption increases.

SUMMARY

An exemplary embodiment provides a solenoid device including:

at least one electromagnetic coil for generating a magnetic flux when energized;

a fixed core constituting part of a magnetic circuit through which the magnetic flux passes; and plungers constituting the magnetic circuit together with the fixed core and configured to advance to and retract from the fixed core depending on whether the electromagnetic coil is energized or de-energized;

the magnetic circuit being provided with a magnetic resistance part as a resistance for the magnetic flux;

the plungers being configured to be attracted to the fixed core by energizing the electromagnetic coil.

According to the exemplary embodiment, there is provided a solenoid device including a plurality of plungers, and capable of maintaining a state where the plurality of plungers are attracted by energizing a single electromagnetic coil thereof.

Other advantages and features of the invention will become apparent from the following description including the drawings and claims.

PREFERRED EMBODIMENTS OF THE INVENTION

Figure 1:
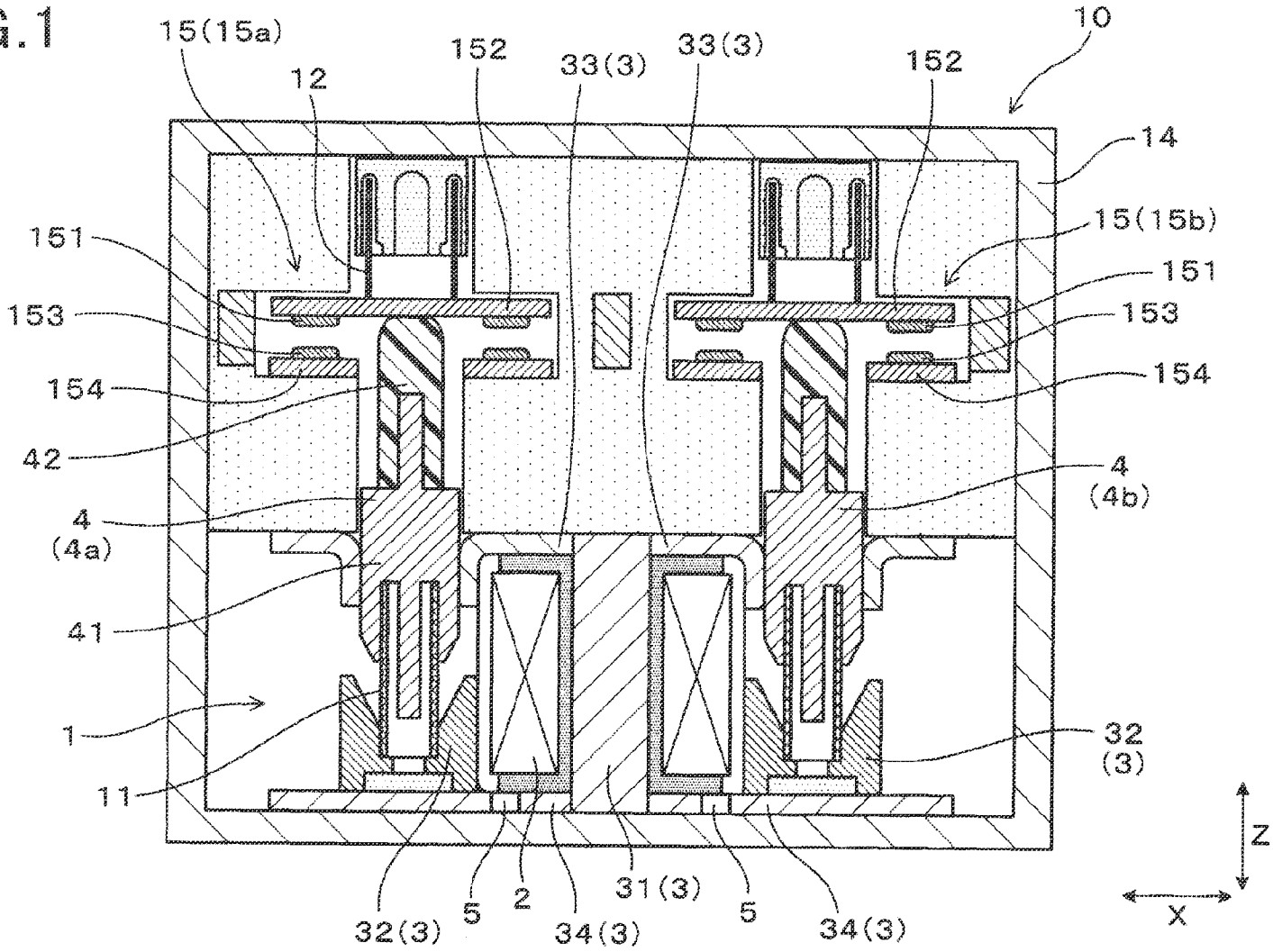
FIG. 1 is a cross-sectional view of an electromagnetic relay including a solenoid device according to a first embodiment of the invention.

In the below described embodiments, the same or equivalent parts or components are indicated by the same reference numerals or characters.

First Embodiment

Figure 2:
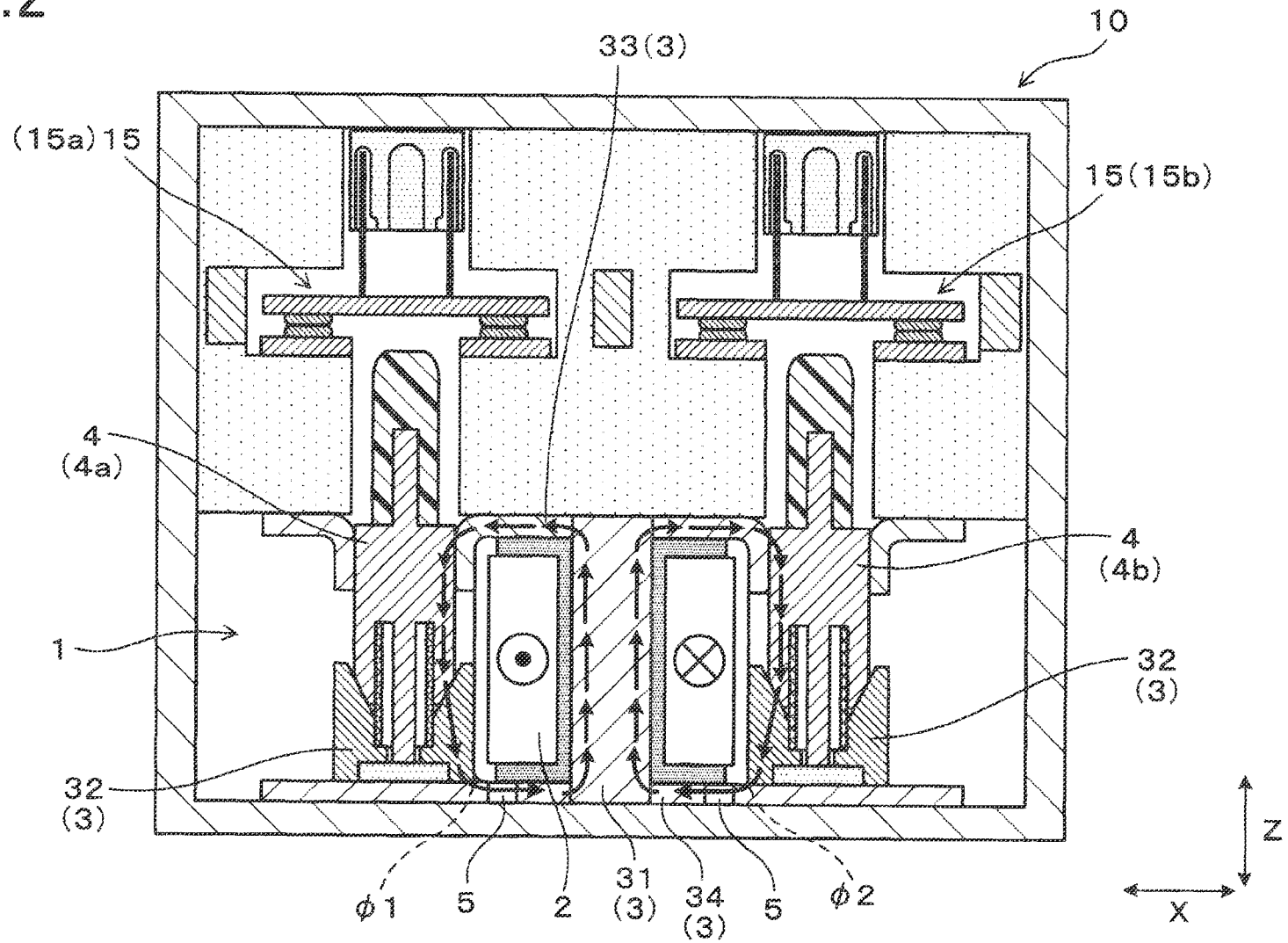
FIG. 2 is a cross-sectional view of the electromagnetic relay according to the first embodiment in the multi-attracting state.

FIG. 1 is a cross-sectional view of an electromagnetic relay including a solenoid device 1 according to a first embodiment of the invention. FIG. 2 is a cross-sectional view of the electromagnetic relay in the multi-attracting state. As shown in FIGS. 1 and 2, the solenoid device 1 includes an electromagnetic coil 2 for generating flux when energized, a fixed core 3 constituting part of a magnetic circuit through which the generated flux passes, and plungers 4 which constitute the magnetic circuit together with the fixed core 3. Each plunger 4 is configured to advance to and retract from the fixed core 3 depending on whether the electromagnetic coil 2 is energized or de-energized.

The magnetic circuit is provided with magnetic resistance parts 5. Each plunger 4 is attracted to the fixed core 3 when the electromagnetic coil 2 is energized. The multi-attracting state, that is the state where the plurality of the plungers 4 are attracted to the fixed core 3 concurrently, can be maintained by energizing the single electromagnetic coil 2.

In this embodiment, there are two plungers 4 (first and second plungers 4*a* and 4*b*). The two plungers are magnetically parallel-connected to each other by the fixed core 3. The two plungers 4 are arranged side by side and moved parallel to each other when the electromagnetic coil 2 is energized or de-energized. The electromagnetic coil 2 is disposed between the two plungers 4 in the arranging direction of the plungers 4. This arranging direction may be referred to as the X-direction hereinafter. The axial direction of the electromagnetic coil 2 is parallel to the moving direction of the plungers 4. This moving direction may be referred to as the Z-direction hereinafter.

The fixed core 3 includes a center core 31 disposed so as to penetrate inside the electromagnetic coil 2, two opposing cores each disposed opposite the corresponding plunger 4 in the Z-direction, a top core 33 magnetically coupling the center core 31 to the plungers 4, and a bottom core 34 magnetically coupling the center core 31 to the opposing cores 32. One closed magnetic path in which a later-described magnetic flux $\phi 1$ is generated by the center core 31 includes the first plunger 4*a*, a corresponding one of the opposing cores 32 and the bottom core 34. Another closed magnetic path in which a later-described magnetic flux $\phi 2$ is generated by the center core 31 includes the second plunger 4*a*, the other opposing core 32 and the bottom core 34. These two closed magnetic paths share the center core 31.

At least part of each plunger 4 is made of a magnetic body part 41. In this embodiment, the magnetic body part 41 is slidable on the top core 33, and disposed facing the opposing core 32. Each plunger 4 further includes a resin-made abutment part 42 mounted to the magnetic body part 4 on the side opposite the opposing core 32. The plunger 4 is configured so as to abut on a later-described movable contact support part 152 at the abutment part 42.

Figure 3:
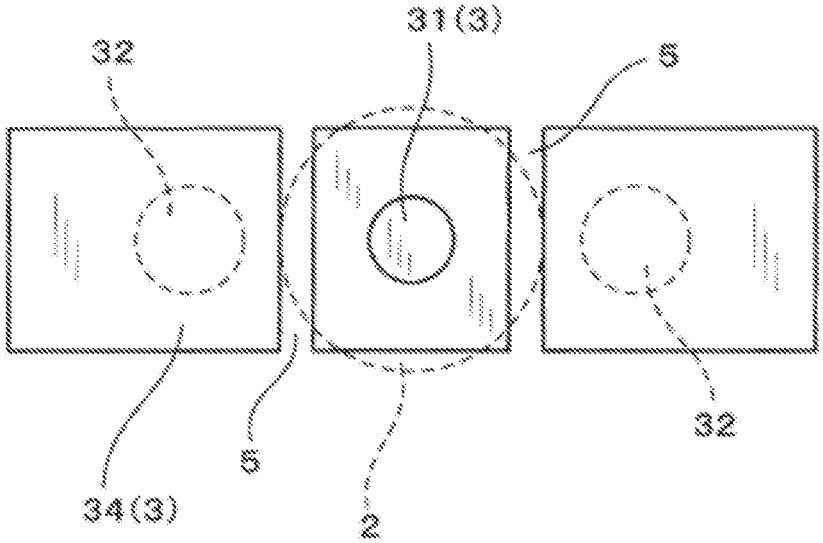
FIG. 3 is a bottom view of a bottom core formed with a magnetic resistance part of the solenoid device according to the first embodiment.
Figure 4:
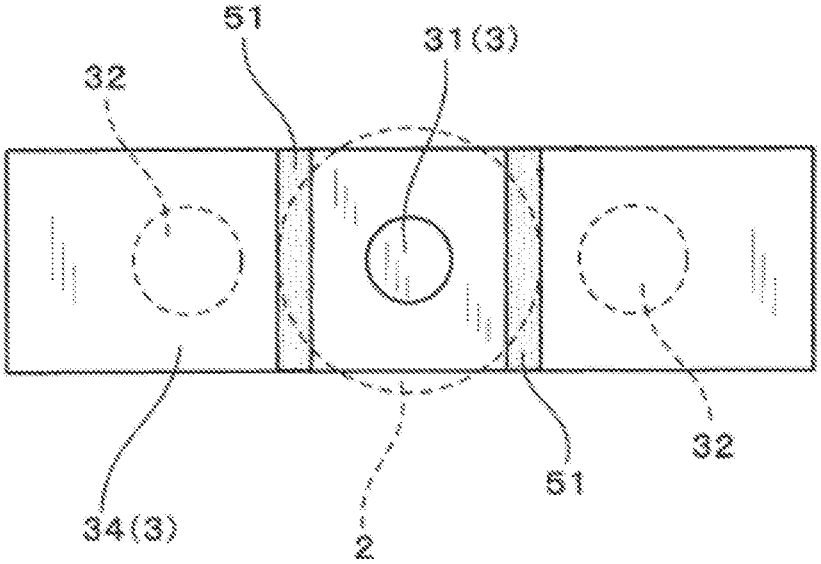
FIG. 4 is a bottom view of the bottom core provided with a low-magnetic permeability member at its magnetic resistance part of the solenoid device according to the first embodiment.

Between the plunger 4 and the opposing core 32, a plunger pressing member 11 is disposed for pressing the plunger 4 in a direction to move the plunger away from the opposing core 32. The plunger pressing member 11 may be made of a coil spring. The magnetic resistance part 5 is provided in the bottom core 34. In this embodiment, the magnetic resistance part 5 is formed of a gap dividing the bottom core 34 in the direction of the magnetic path. The gap forming the magnetic resistance part 5 may be an air gap as shown in FIG. 3. A low magnetic permeability member 51 whose magnetic permeability is lower than that of the fixed core 3 may be disposed in the gap as shown in FIG. 4. The low magnetic permeability member 51 may be made of resin. When the low magnetic permeability member 51 is disposed in the gap, the rigidity of the fixed core 3 can be increased compared to when the magnetic resistance part 5 is formed of the air gap itself.

As shown in FIGS. 1 and 2, the solenoid device 1 is used for an electromagnetic relay 10.

The electromagnetic relay 10 includes a case 14 which houses the solenoid device 1 and two switching parts 15 (the first and second switching parts 15*a* and 15*b*). Each of the switching parts 15 includes the movable contact support part 152 supporting two movable contacts 151 and two fixed contact support parts 154 each supporting a fixed contact 153. Between the top wall of the case 14 and each movable contact support part 152, there is disposed a contact pressing member 12 for pressing the corresponding movable contact support part 152 in the Z-direction toward the fixed contact support parts 154. The contact pressing member 12 may be formed of a coil spring or the like. The pressing force (spring constant) of the contact pressing member 12 is smaller than that of the plunger pressing member 11.

The abutment parts 42 of the plungers 4*a* and 4*b* are abutable on the corresponding movable contact support parts 152. By advancing or retracting the plungers 4, the movable contacts 151 and the fixed contacts 153 can be made in contact with each other or out of contact from each other to switch the switching parts 15 between the on state where a current flows between the two fixed contacts 154 through the movable contact support part 152 (FIG. 2) and the off state where no current between them (FIG. 1).

More specifically, by energizing the electromagnetic coil 2 when the switching parts 15*a* and 15*b* are in the off state (FIG. 1), the magnetic flux $\phi 1$ is generated in the closed magnetic path including the first plunger 4*a*, and the magnetic flux $\phi 2$ is generated in the magnetic path including the second plunger 4*b*, as a result of which these plungers 4*a* and 4*b* are attracted to the fixed core 3 (opposing cores 32). Accordingly, the movable contact support parts 152 moves toward the solenoid device 1, and the switching parts 15*a* and 15*b* turn on, that is, become the on state (FIG. 2) where the movable contacts 151 are in contact with the fixed contacts 153.

The on state of the switching parts 15*a* and 15*b* continues as long as the electromagnetic coil 2 is energized. To switch the switching parts 15 from the on state to the off state, the electromagnetic coil 2 is de-energized to release the attraction of the plungers 4 to the fixed core 3. As a result, the plungers 4 push up the movable contact support parts 152 using biasing forces of the plunger pushing members 11.

Figure 5:
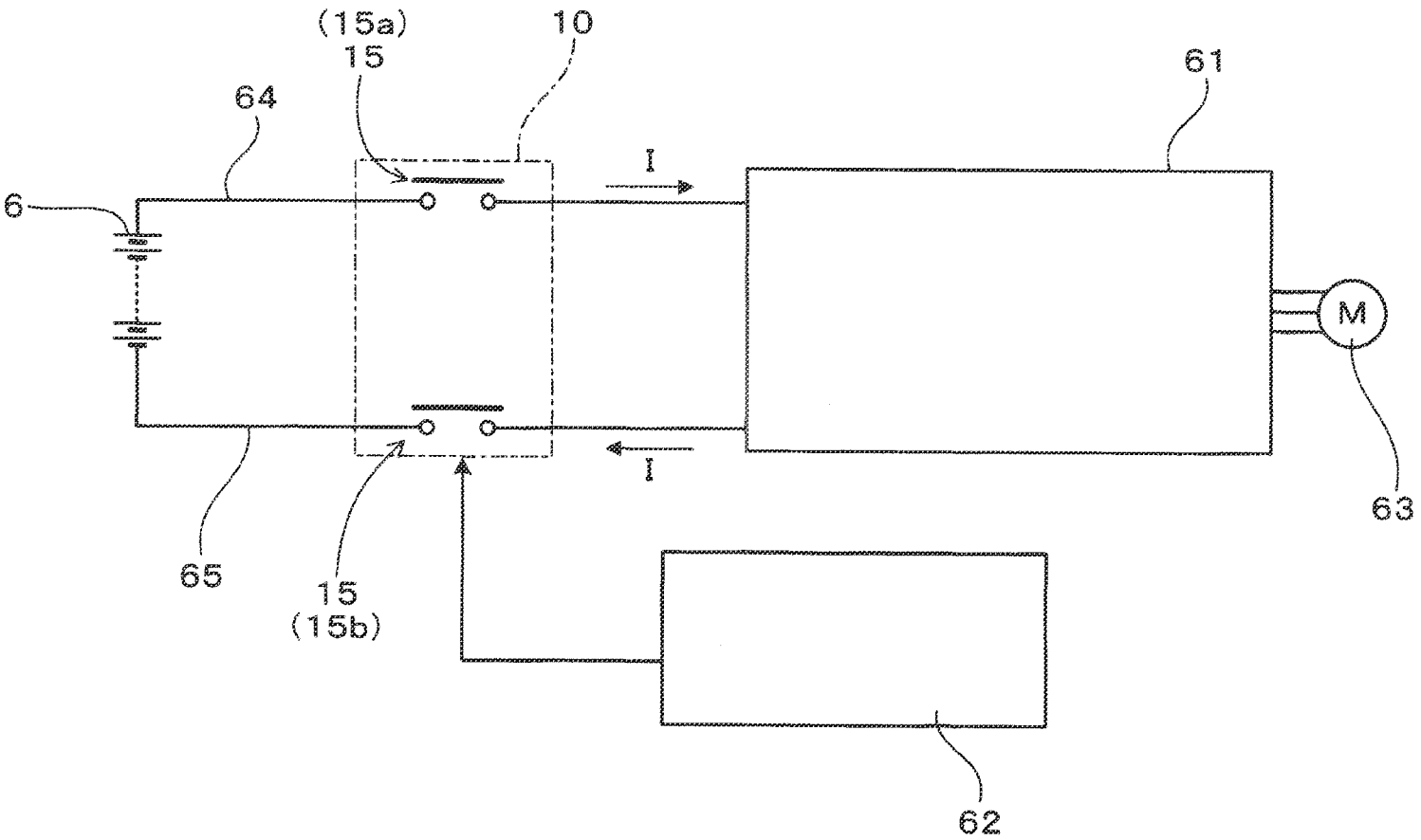
FIG. 5 is a circuit diagram of a power supply system for driving a motor, the system including an inverter, the electromagnetic relay with the solenoid device according to the first embodiment, a DC power source and a control circuit, the electromagnetic relay being disposed between the inverter and the DC power source.

As shown in FIG. 5, the electromagnetic relay 10 including the solenoid device 1 is used for a power supply system which includes a DC power source 6, an inverter 61 and a control circuit 62. The electromagnetic relay 10 is for connection and disconnection between the inverter 61 and the DC power source 6. The inverter 61 operates to convert DC power from the DC power source 6 to AC power to be supplied to a three-phase AC motor 63. The one switching part 15*a* of the electromagnetic relay 10 is provided in a positive line 64 connected between the positive electrode of the DC power source 6 and the inverter 61. The other switching part 15*b* of the electromagnetic relay 10 is provided in a negative line 65 connected between the negative electrode of the DC power source 6 and the inverter 61. The electromagnetic relay 10 is switched between the on state and the off state in accordance with a control signal outputted from the control circuit 62 to make and break connection between the inverter 61 and the DC power source 6. The power supply system shown in FIG. 5 can be used for a hybrid vehicle, a plug-in hybrid vehicle and an electric vehicle, for example.

The power supply system shown in FIG. 5 can block a DC current I from flowing to the inverter 61 even if one of the switching parts 15*a* and 15 sticks when the electromagnetic relay 10 is switched from the on state to the off state.

The first embodiment provides the following advantages. The multi-attracting state is maintained as long as the single electromagnetic coil 2 is energized. Accordingly, according to this embodiment, since the state where the plurality of the plungers are attracted can be maintained without using two or more electromagnetic coils, the power consumption can be reduced.

The magnetic circuit is provided with the magnetic resistance parts 5. This makes it possible to establish the multi-attracting state (FIG. 2) easily. That is, by providing the magnetic resistance parts 5 in appropriate parts of the magnetic circuit, it becomes possible for the single electromagnetic coil 2 to generate the magnetic fluxes $\phi 1$ and $\phi 2$ in the closed magnetic paths each including the corresponding plunger.

More specifically, in the first embodiment having two closed magnetic paths (referred to as first and second magnetic paths here, the first magnetic path having a less magnetic resistance than the second closed magnetic path), when the electromagnetic coil 2 starts to be energized, the magnetic flux $\phi 1$ is generated first in the first closed magnetic path. Accordingly, the first plunger 4*a* is attracted to the fixed core 3 (bottom core 32). As a result, since the magnetic resistance of the first magnetic path decreases, it becomes difficult to generate the magnetic flux $\phi 2$ in the second magnetic path. If the magnetic resistance part 5 is not provided in the first closed magnetic path, it is difficult to generate the magnetic flux $\phi 2$ in the second closed magnetic path even if a large current is passed to the electromagnetic coil 2 to generate a large magnetomotive force.

This is because, when the first plunger 4*a* is attracted, the magnetic resistance of the magnetic path through which the magnetic flux $\phi 1$ passes becomes minimum, and accordingly the magnetic flux $\phi 1$ becomes very large if the magnetic resistance part 5 is not provided. In this case, the magnetic flux density in the center core 31 serving as a magnetic circuit common to the magnetic flux $\phi 1$ and the magnetic flux $\phi 2$ increases nearly to the level of magnetic saturation. That is, the magnetic resistance of the center core 31 increases greatly. As a result, since the magnetic flux $\phi 2$ becomes hard to increase, it becomes difficult to attract the plunger 4*b*. That is why this embodiment is provided with the magnetic resistance parts 5. The provision of the magnetic resistance parts 5 enables restricting the magnetic flux $\phi 1$ passing through the first closed magnetic path, so that the magnetic flux $\phi 2$ can be generated at sufficient magnitude in the second closed magnetic path.

Hence, according to this embodiment, the magnetic fluxes $\phi 1$ and □2 can be prevented from being greatly different from each other in magnitude. As a result, since the two plungers 4*a* and 4*b* can be attracted stably without greatly increasing the current supplied to the electromagnetic coil 2, the power consumption necessary for maintaining the multi-attracting state can be made small.

Particularly, when the plungers 4*a* and 4*b* continues to be attracted to the fixed core 3 for a long time, the power consumption can be greatly reduced. In this embodiment where the solenoid device 1 is used for the electromagnetic relay 10 for making and breaking connection between the inverter 61 and the DC power source 6, the two switching parts 15*a* and 15*b* are kept on while the inverter 61 is in operation. To keep the switching parts 15*a* and 15*b* on, the multi-attracting state where the two plungers 4*a* and 4*b* are attracted to the fixed core 3 has to be maintained. That is, the multi-attracting state has to be maintained while the inverter 61 is in operation. Hence, the advantage that the multi-attracting state can be maintained by supplying a relatively small current to the single electromagnetic coil 2 makes it possible to greatly reduce the power consumption of the solenoid device 1. In addition, the solenoid device 1 can be manufactured at low cost and made compact because it includes only one electromagnetic coil.

The magnetic resistance part 5 of the solenoid device 1 is formed by the gap dividing a part of the fixed core 3 in the direction of the magnetic path. Accordingly, the magnetic design of the solenoid device 1 is easy compared to the case where the magnetic resistance part 5 is formed by a small-diameter portion 52 (see FIG. 6) as is the case with a second embodiment described later. In the case of forming the magnetic resistance part 5 by the small-diameter portion 52, it is necessary that the closed magnetic path including the plunger that has been attracted first is saturated to enable attracting both the plungers using the single electromagnetic coil 2.

The magnetic resistance of the small-diameter portion 52 is small at the beginning of attraction of the plunger 4. However, at the end of the attraction, since the gap between the plunger 4 and the opposing core 32 becomes small and accordingly the magnetic resistance of the entire of the closed magnetic path becomes small, the magnetic flux density at the small-diameter portion 52 becomes large. At this time, the small-diameter portion 52 of the closed magnetic path including the plunger that has been attracted first has to be saturated to increase the magnetic resistance. That is, for the magnetic circuit to have a magnetic resistance appropriate to maintain the multi-attracting state by using the single electromagnetic coil 2, it is necessary to accurately design the magnetic saturation region of the magnetic circuit. However, since there is individual variation in the BH curve, the magnetic design has to be carried out taking into consideration the individual variation. On the other hand, in the first embodiment, since the magnetic resistance part 5 is formed by the gap, the desired magnetic resistance can be easily designed based on the length and area of the gap.

As explained above, according to the first embodiment, there is provided a solenoid device capable of reducing power consumption.

Second Embodiment

Figure 6:
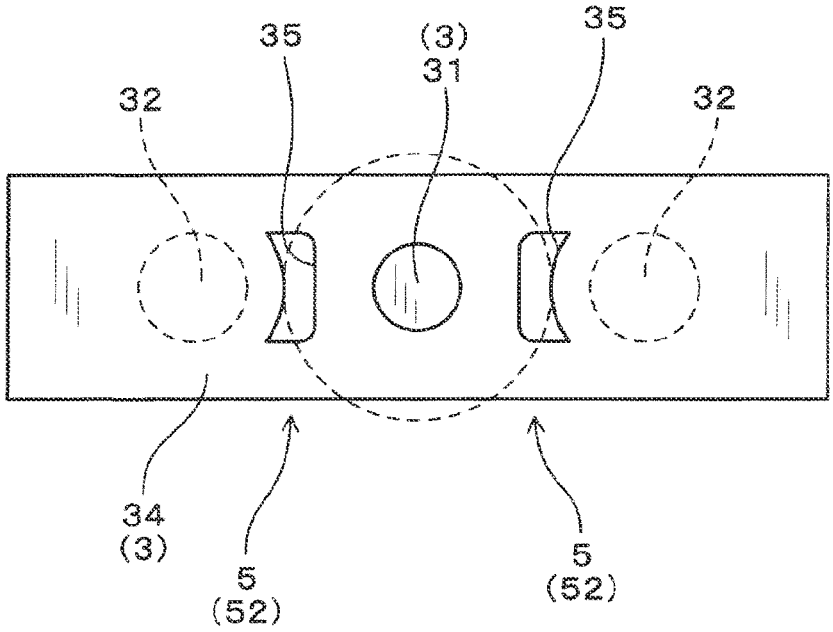
FIG. 6 is a bottom view of a bottom core formed with a magnetic resistance part of a solenoid device according to a second embodiment of the invention.

Next, a second embodiment of the invention is described with reference to FIG. 6. As shown in FIG. 6, in the second embodiment, the magnetic resistance part 5 is formed by the small-diameter portion 52 having a cross-sectional area which is smaller than that of any other parts of the closed magnetic path. More specifically, a through hole 35 is made in the fixed core 30 to form the small-diameter portion 52 to be used as the magnetic resistance part 5. Other than the above, the second embodiment is the same in structure as the first embodiment.

Also in this embodiment, it is possible to generate a sufficient flux in each of the two closed magnetic paths without supplying a large current to the electromagnetic coil 2. Further, by making the cross-sectional area of the small-diameter portion 52 sufficiently small to cause magnetic saturation, the magnetic flux density can be limited appropriately. Other than the above, the second embodiment provides the same advantages as those provided by the first embodiment.

Third Embodiment

Figure 7:
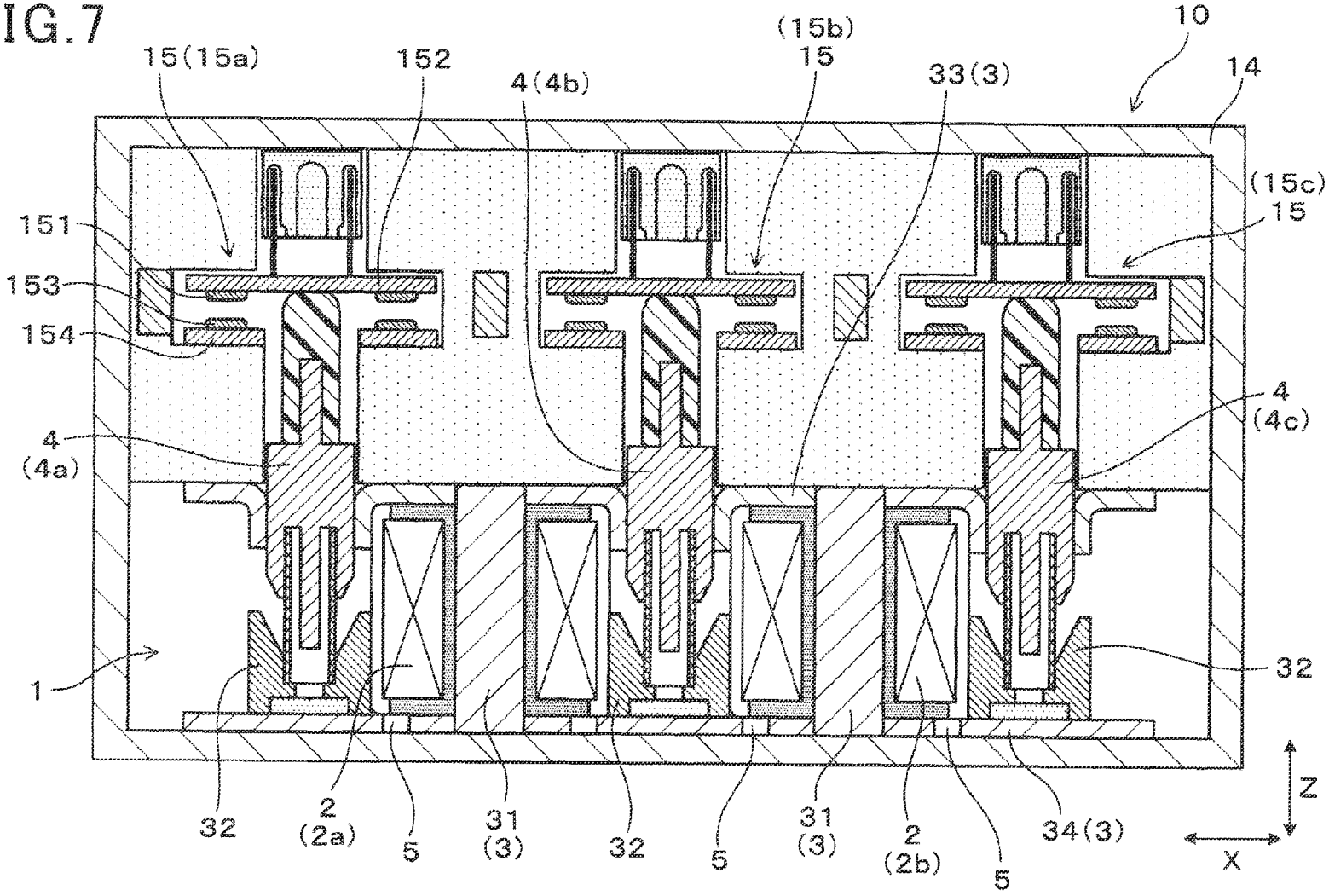
FIG. 7 is a cross-sectional view of an electromagnetic relay including a solenoid device according to a third embodiment of the invention.
Figure 8:
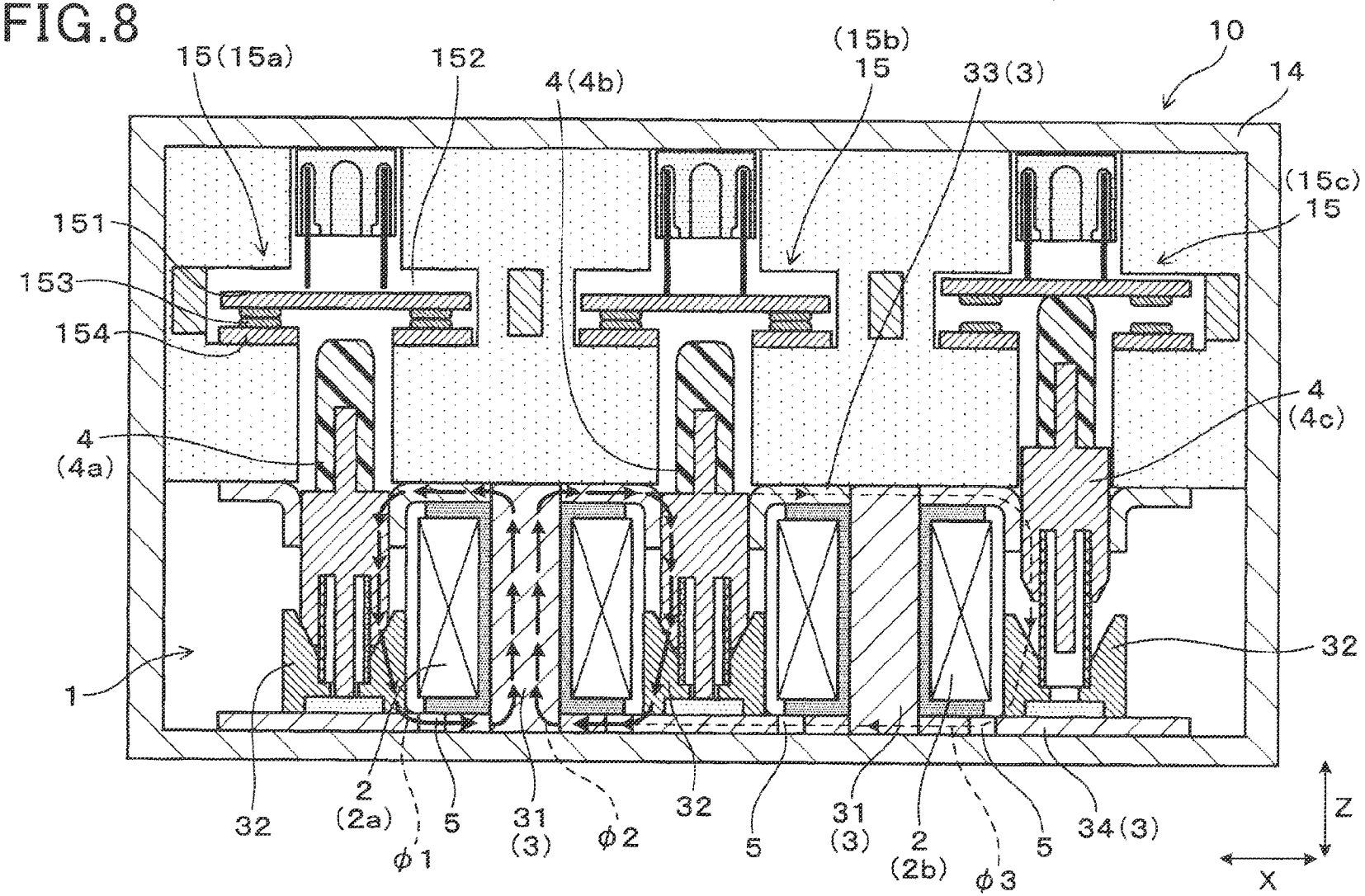
FIG. 8 is a cross-sectional view of the electromagnetic relay including the solenoid device according to the third embodiment in a state where first and second plungers thereof are attracted.

Next, a third embodiment is described with reference to FIGS. 7 to 10. As shown in FIG. 7, the solenoid device 1 according to the third embodiment includes two electromagnetic coils 2 (first and second electromagnetic coils 2*a* and 2*b*) and three plungers 4 (first, second and third plunger 4*a*, 4*b* and 4*c*). All the axes of the two electromagnetic coils 2 and the three plungers 4 are parallel to one another. The first electromagnetic coil 2*a* is disposed between the first plunger 4*a* and the second plunger 4*b*. The second electromagnetic coil 2*b* is disposed between the second plunger 4*b* and the third plunger 4*c*.

In this embodiment, the fixed core 3 includes two center cores 31 and three opposing cores 32. The top core 33 is disposed so as to connect the center cores 31 to the plungers 4. The bottom core 34 is disposed so as to connect the center cores 31 to the opposing cores 32. The bottom core 34 is formed with the magnetic resistance parts 5.

The solenoid device 1 according to this embodiment is used in the electromagnetic relay 10. The electromagnetic relay 10 includes three switching parts 15 (first, second and third switching parts 15*a*, 15*b* and 15*c*) which are turned on and off by the three plungers 4.

Next, the operation of the electromagnetic relay 10 including the solenoid device 1 according to the third embodiment is described. By energizing the first electromagnetic coil 2*a* when the three switching parts 15 are in the off state (FIG. 7), the magnetic flux $\phi 1$ is generated in the closed magnetic path including the first plunger 4*a*, and the magnetic flux $\phi 2$ is generated in the closed magnetic circuit path including the second plunger 4*b*, as a result of which these two plungers 4*a* and 4*b* are attracted to the fixed core 3 (to the corresponding opposing cores 32). Accordingly, the two movable contact support parts 152 move toward the solenoid device 1, and the first and second switching parts 15*a* and 15*b* become the on state where each movable contact 151 is in contact with the corresponding fixed contact 153. At this time, a magnetic flux $\phi 3$ is generated in the closed magnetic path passing inside the first electromagnetic coil 2*a* and the third plunger 4*c*. However, since the magnetic resistance of this closed magnetic path is relatively large, the third plunger 4*c* is not attracted to the opposing core 32 at this time.

Incidentally, the magnetic resistance of this closed magnetic path can be adjusted by the magnetic resistance part 5 provided in the bottom core 34 between the center core 31 within the second electromagnetic coil 2*b* and the opposing core 32 opposed to the third plunger 4*c*.

Figure 9:
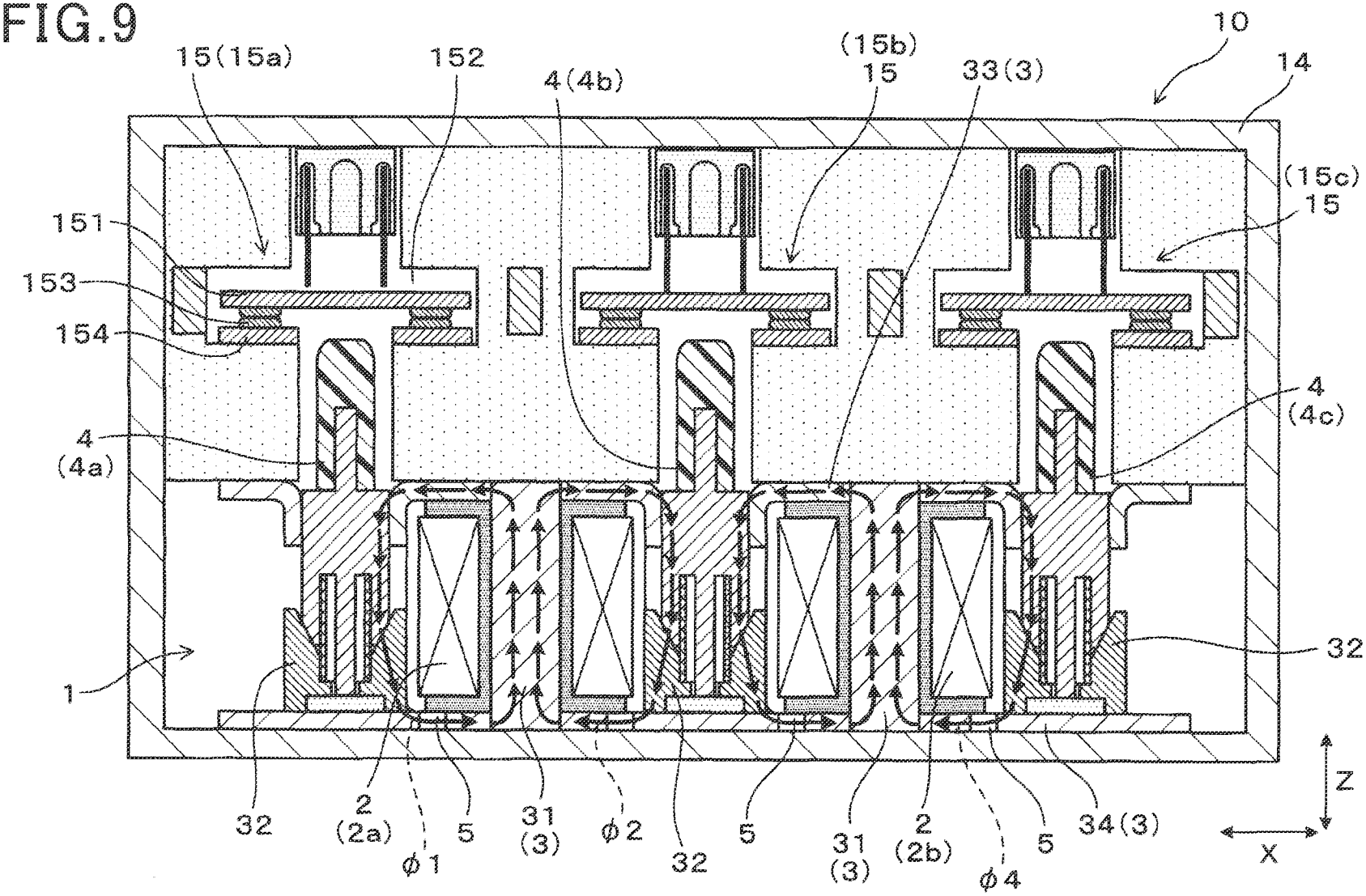
FIG. 9 is a cross-sectional view of the electromagnetic relay including the solenoid device according to the third embodiment brought to the multi-attracting state.

Subsequently, the second electromagnetic coil 2*b* is energized while maintaining energization of the first electromagnetic coil 2*a* as shown in FIG. 9. As a result, a magnetic flux flows from the second electromagnetic coil 2*b* to the third plunger 4*c*, and the magnetic flux $\phi 4$ is generated sufficiently in the closed magnetic path including the third plunger 4*c*, as a result of which the third plunger 4*c* is attracted to the fixed core 3 (corresponding opposing core 32) to thereby turn on the switching part 15*c*.

Figure 10:
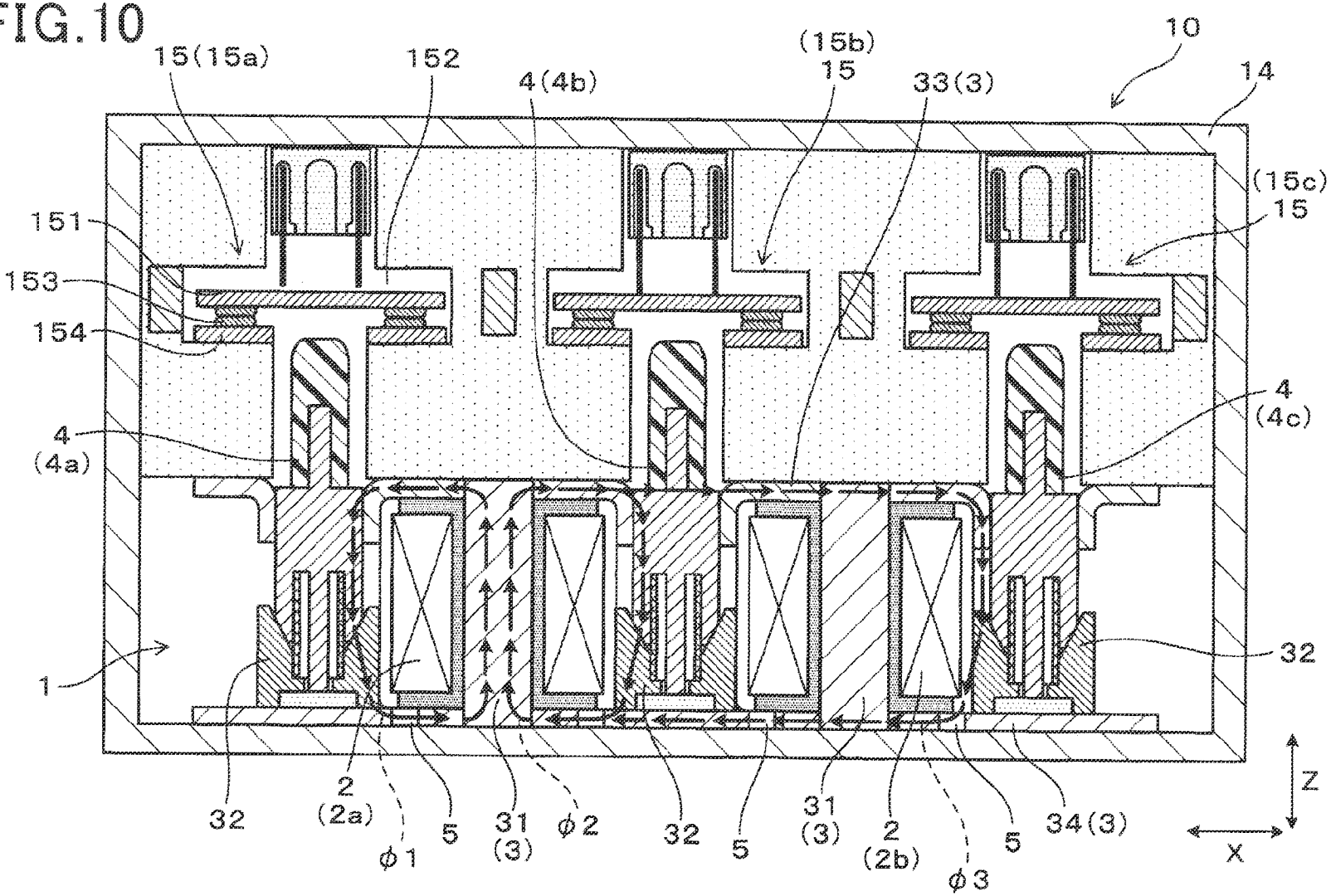
FIG. 10 is a cross-sectional view of the electromagnetic relay including the solenoid device according to the third embodiment maintained in the multi-attracting state.

In the multi-attracting state where the three plungers 4 are attracted to the opposing cores 32, the magnetic resistances of the three closed magnetic paths are small. Accordingly, in this embodiment, the state where the three plungers 4 are attracted is maintained only by the magnetomotive force of one of the two electromagnetic coils 2 (for example, the first electromagnetic coil 2*a*) while de-energizing the other of the electromagnetic coils 2 (for example, the second electromagnetic coil 2*b*) as shown in FIG. 10. As described above, according to this embodiment, the multi-attracting state where the three plungers 4 are attracted to the opposing cores 32 can be maintained at low power consumption.

Other than the above, the third embodiment is the same in structure as the first embodiment.

According to the third embodiment, it is possible to reduce power consumption of the solenoid device 1 including the three plungers 4. Other than the above, the third embodiment provides the same advantages as those provided by the first embodiment.

Fourth Embodiment

Figure 11:
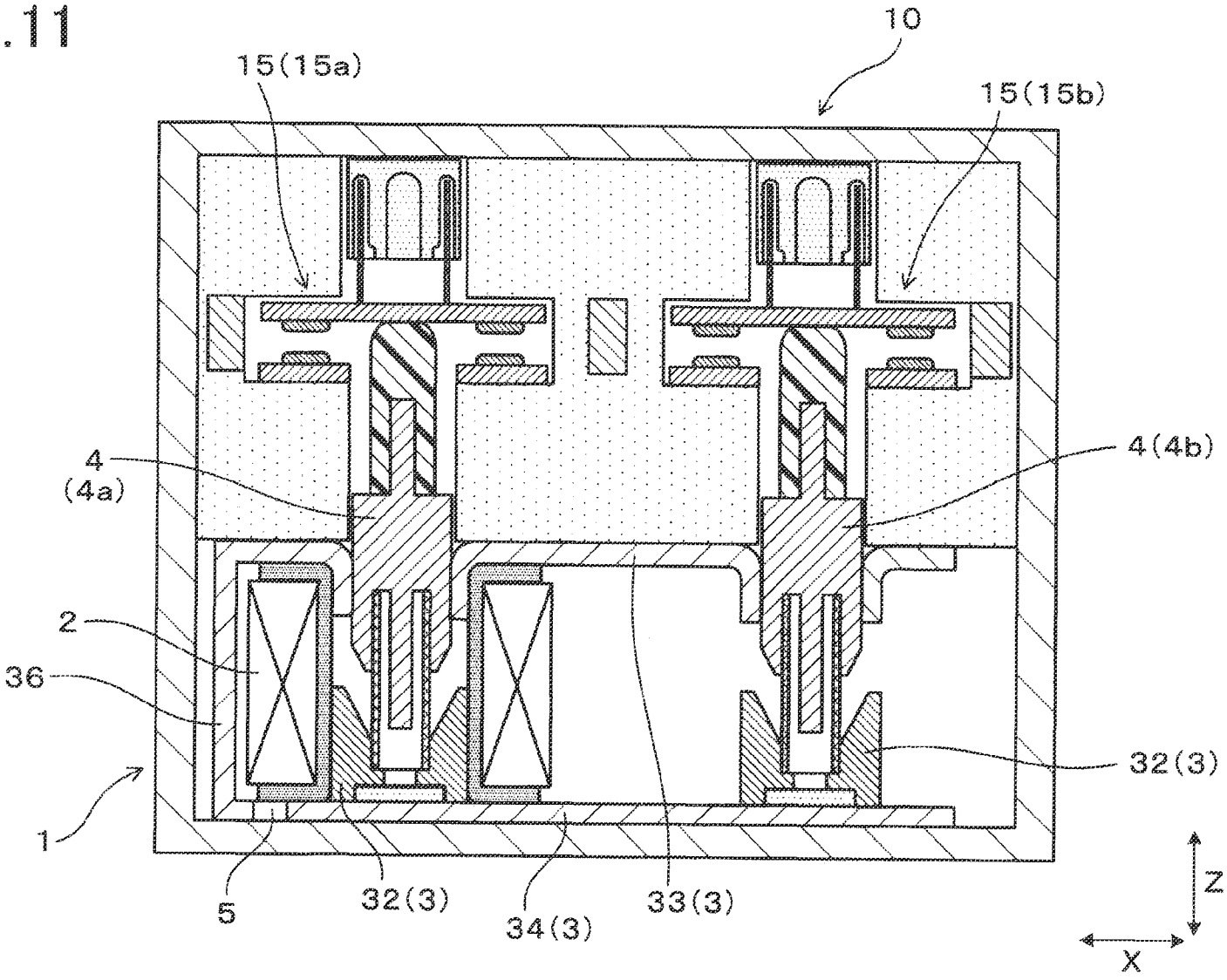
FIG. 11 is a cross-sectional view of an electromagnetic relay including a solenoid device according to a fourth embodiment of the invention.

Next, a fourth embodiment of the invention is described with reference to FIG. 11. As shown in FIG. 11, the solenoid device 1 according to the fourth embodiment includes one electromagnetic coil 2 and two plungers 4 (first and second plungers 4*a* and 4*b*) one of which is disposed within the electromagnetic coil 2. More specifically, the first plunger 4*a* is disposed inside the electromagnetic coil 2, and the second plunger 4*b* is disposed outside the electromagnetic coil 2. The two plungers 4*a* and 4*b* are parallel to each other.

The fixed core 3 includes two opposing cores 32 respectively disposed opposite to the corresponding plungers 4, a bottom core 34 connecting the two opposing cores 32 to each other, and a top 6 core 33 connecting the two plungers 4 to each other. The fixed core 3 includes a side core 36 connecting the bottom core 34 and the top core 33 to each other outside the electromagnetic coil 2. The side core 36 is disposed adjacent to the lateral side of the electromagnetic coil 2 at the side far from the second plunger 4*b* in the X-direction. The magnetic resistance part 5 is formed in a part of the bottom core 34, which is between the opposing core 32 opposite the first plunger 4*a* and the side core 36.

Next, the operation of the electromagnetic relay 30 including the solenoid device 1 according to the fourth embodiment is described. By energizing the electromagnetic coil 2 when the two switching parts 15 are in the off state (FIG. 11), a magnetic flux is generated in the closed magnetic path including the first plunger 4*a* and the side core 36. As a result, the first plunger 4*a* is attracted to the opposing core 32 to turn on the switching part 15*a*.

When the first plunger 4*a* is attracted to the opposing core 32, the magnetic resistance of the closed magnetic path including the two plungers 4*a* and 4*b* becomes small. At this time, also the magnetic resistance of the closed magnetic path including the first plunger 4*a* and the side core 36 becomes small. However, the magnetic flux generated in this closed magnetic path is limited by the magnetic resistance part 5. Accordingly, a sufficient magnetic flux is generated also in the other closed magnetic path including the two plungers 4*a* and 4*b*. Therefore, also the second plunger 4*b* is attracted to the opposing core 32 and the second switching part 15*b* is turned on.

In this multi-attracting state where the two plungers 4 are attracted, a sufficient magnetic flux is generated in each of the two closed magnetic paths by energization of the single electromagnetic coil 2. Accordingly, by energization of the single electromagnetic coil 2, the state of the two plungers 4 being attracted can be maintained to keep the two switching parts 15 on.

Other than the above, the fourth embodiment provides the same advantages as those provided by the first embodiment.

Fifth Embodiment

Figure 12:
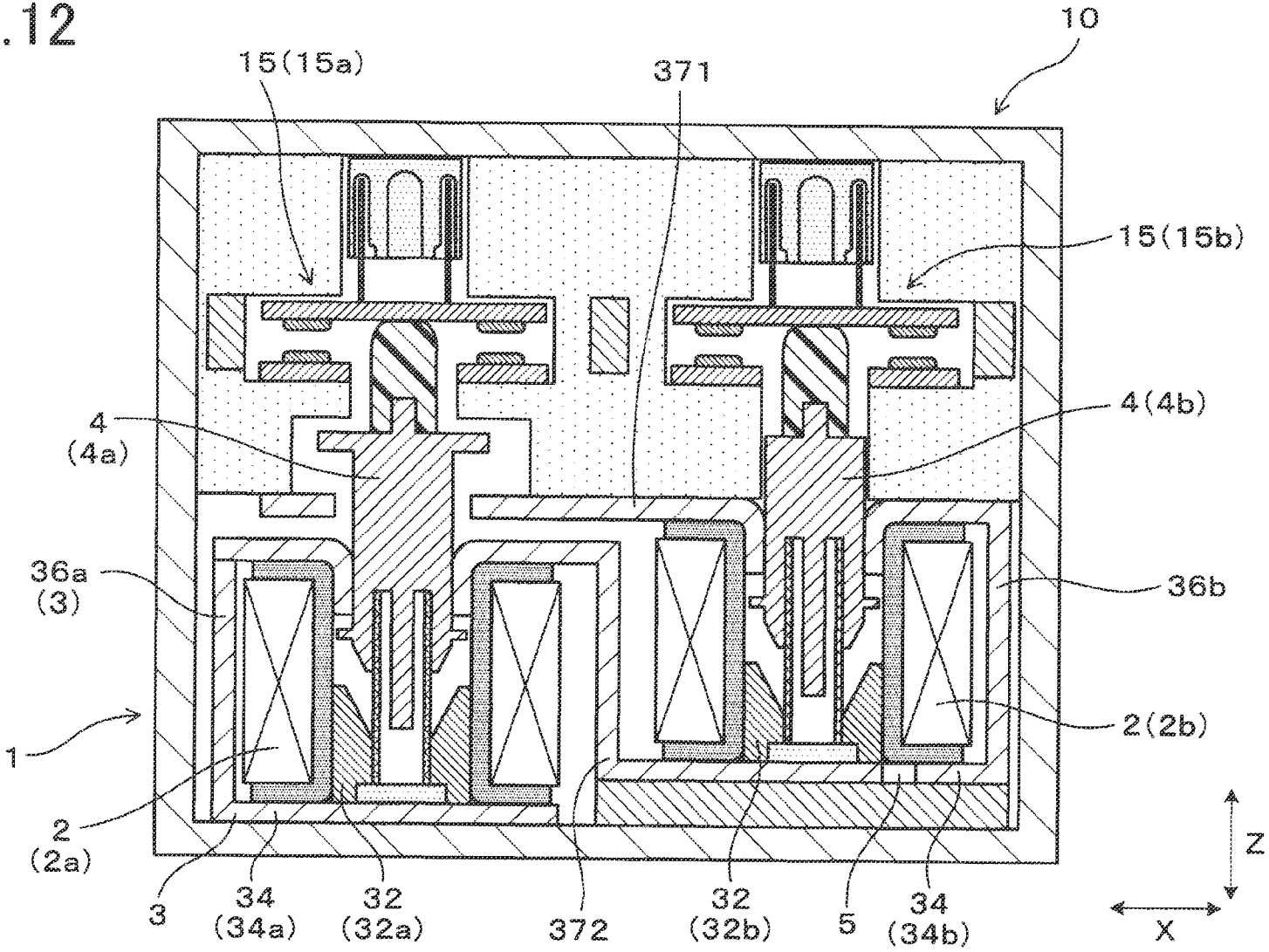
FIG. 12 is a cross-sectional view of an electromagnetic relay including a solenoid device according to a fifth embodiment of the invention.

Next, a fifth embodiment of the invention is described with reference to FIGS. 12 to 15. As shown in FIG. 12, the solenoid device 1 according to the fifth embodiment includes two electromagnetic coils 2 (first and second electromagnetic coils 2*a* and 2*b*) and two plungers 4 (first and second plungers 4*a* and 4*b*). The two plungers 4*a* and 4*b* are disposed within the two electromagnetic coils 2*a* and 2*b*, respectively. The fixed core 3 includes two opposing cores 32 (first and second opposing cores 32*a* and 32*b*) respectively provided in two plungers 4 (first and second plungers 4*a* and 4*b*) so as to be opposite to each other in the Z-direction. The two opposing cores 32 are connected respectively to two bottom cores 34 (first and second bottom cores 34*a* and 34*b*). The first and second plungers 4*a* and 4*b* are magnetically connected to each other through a first coupling core 371. The first plunger 4*a* and the second plunger 4*b* are magnetically connected to each other through a second coupling core 372. The second coupling core 372 is partially disposed between the two electromagnetic coils 2 in the X-direction.

The first bottom core 34*a* and the first plunger 4*a* are coupled to each other through a first side core 36*a* extending outside the first electromagnetic coil 2*a* at the side opposite the second electromagnetic coil 2*b*. The second bottom core 34*b* and the second plunger 4*b* are coupled to each other through a second side core 36*b* extending outside the second electromagnetic coil 2*b* at the side opposite the first electromagnetic coil 2*a*. The magnetic resistance part 5 is formed in the second bottom core 34*b* between the second opposing core 32*b* and the second side core 36*b*.

Figure 13:
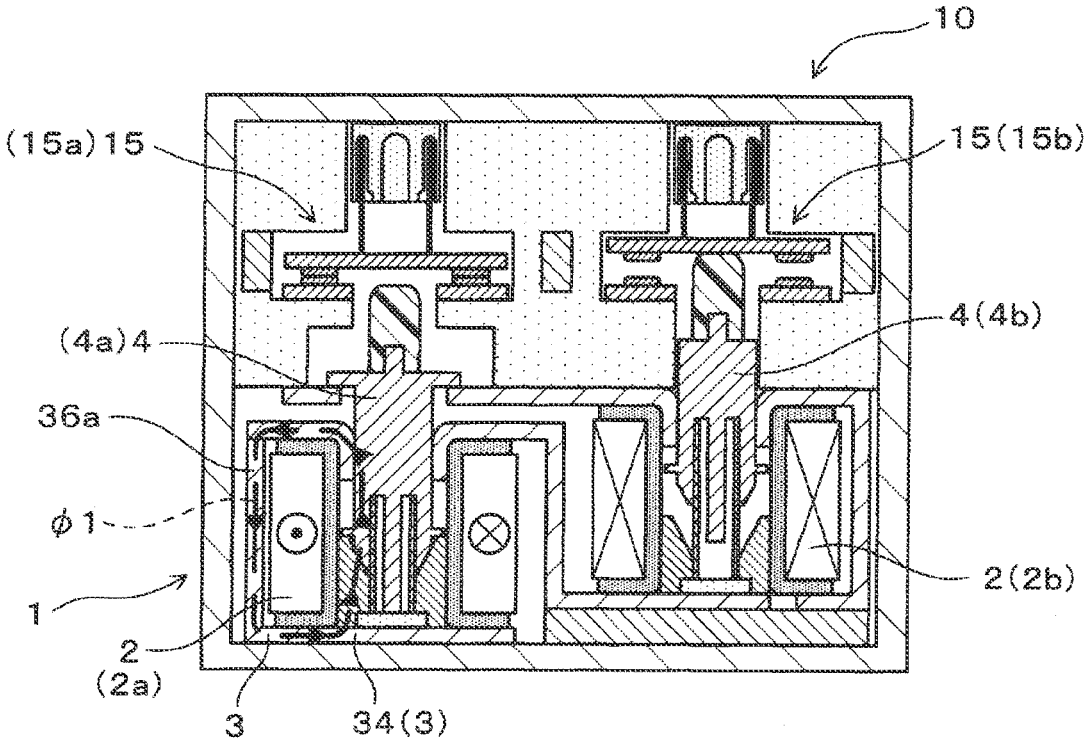
FIG. 13 is a cross-sectional view of the electromagnetic relay including the solenoid device according to the fifth embodiment in a state where a first plunger thereof is attracted.
Figure 14:
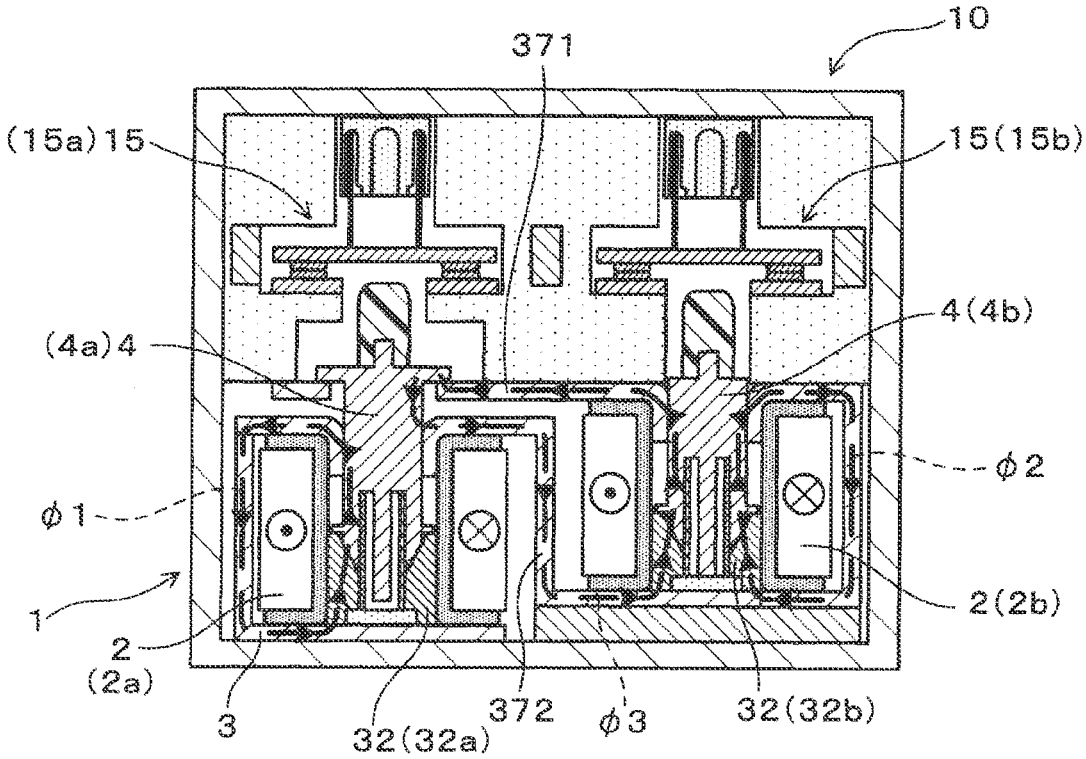
FIG. 14 is a cross-sectional view of the electromagnetic relay including the solenoid device according to the fifth embodiment brought to the multi-attracting state.

Next, the operation of the solenoid device 1 according to the fifth embodiment is explained. The first electromagnetic coil 2*a* is energized when the two plungers 4 are not attracted to the opposing cores 32 (FIG. 12). As a result, the magnetic flux $\phi 1$ is generated in the closed magnetic path including the first plunger 4*a* and the first side core 36*a*, and the first plunger is attracted to the first opposing core 32*a* as shown in FIG. 13.

Subsequently, the second electromagnetic coil 2*b* is energized as a result of which the magnetic flux $\phi 2$ is generated in the closed magnetic path including the second plunger 4*b* and the second side core 36*b*, and the second plunger 4*b* is attracted to the second opposing core 32*b*. At this time, since the two plungers 4 are attracted to the fixed core 3 (opposing cores 32), the magnetic resistance of the closed magnetic path including the two plungers 4 and the first and second coupling cores 371 and 372 is small. Further, since the magnetic resistance part 5 is provided in the closed magnetic path in which the magnetic flux $\phi 2$ is generated, the magnitude of the flux $\phi 2$ is limited. Accordingly, by energizing the second electromagnetic coil 2*b*, the magnetic flux $\phi 3$ is generated in the closed magnetic path including the two plungers 4 and the first and second coupling cores 371 and 372.

Figure 15:
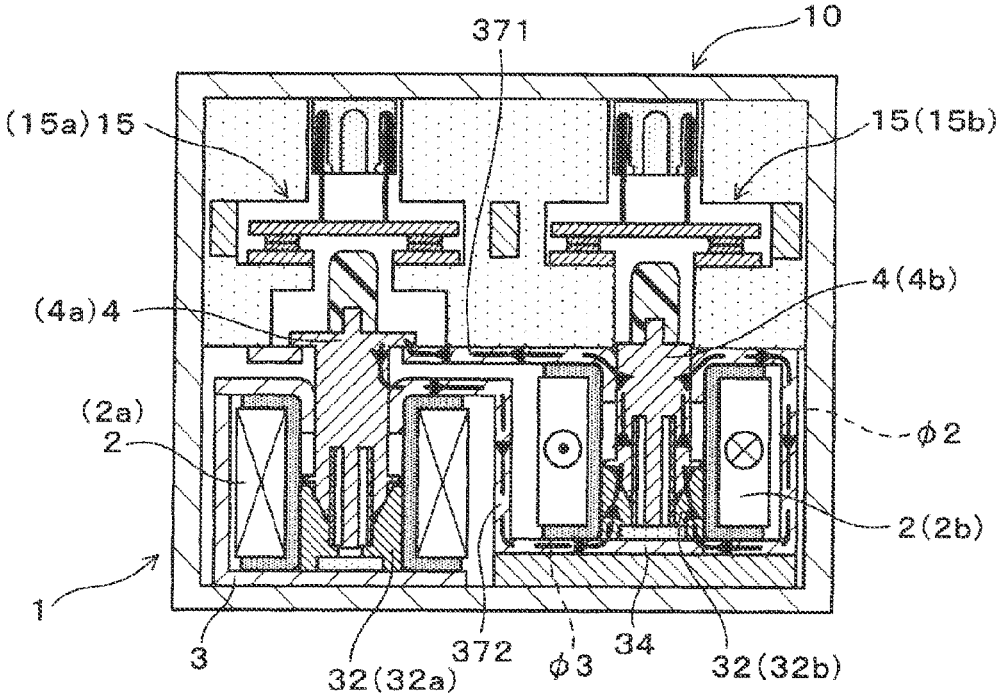
FIG. 15 is a cross-sectional view of the electromagnetic relay including the solenoid device according to the fifth embodiment maintained in the multi-attracting state.

Thereafter, to reduce the power consumption for maintaining the multi-attracting state where the two plungers 4 are attracted to the opposing cores 32, the first electromagnetic coil 2*a* is de-energized as shown in FIG. 15. This is because once the multi-attracting state has been achieved, since the magnetic resistance of the closed magnetic path in which the magnetic flux $\phi 3$ is generated is small, it can be maintained without generating a large magnetomotive force. Hence, the multi-attracting state can be maintained by maintaining energization of only the second electromagnetic coil 2*b*.

Other than the above, the fifth embodiment is the same in structure as the first embodiment, and provides the same advantages as those provided by the first embodiment.

Sixth Embodiment

Figure 16:
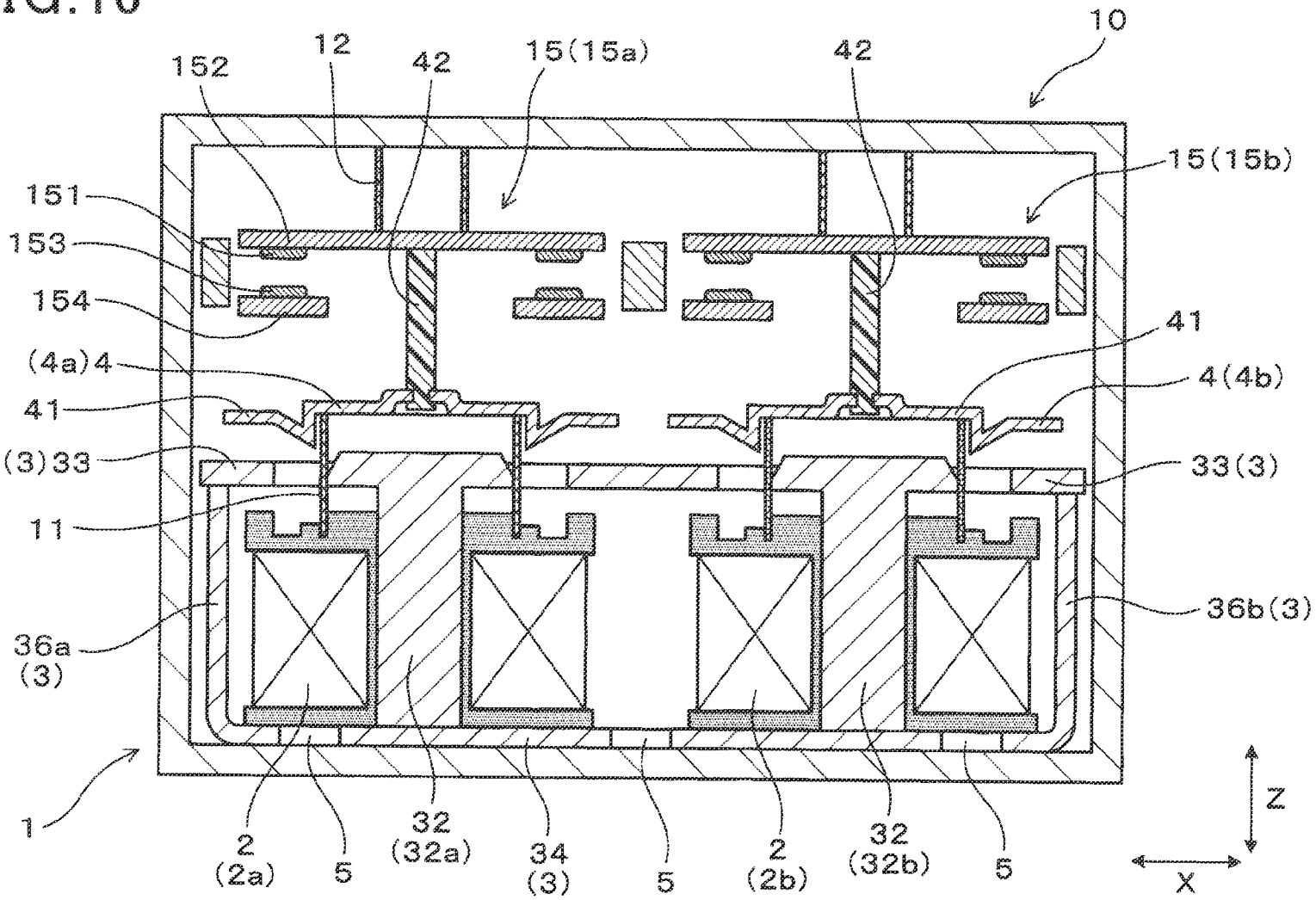
FIG. 16 is a cross-sectional view of an electromagnetic relay including a solenoid device according to a sixth embodiment of the invention.

Next, a sixth embodiment of the invention is described with reference to FIG. 16 to 18. The solenoid device 1 according to the sixth embodiment includes two electromagnetic coils 2 (first and second electromagnetic coils 2*a* and 2*b*) and two plungers 4 (first and second plungers 4*a* and 4*b*). In this embodiment, each of the two opposing cores 32 (the first and second opposing cores 32*a* and 32*b*) constituting part of the fixed core 3 penetrates inside a corresponding one of the two electromagnetic coils 2. The two plungers 4 are disposed so as to be opposed to the respective opposing cores 32 in the Z-direction. Each plunger 4 is disposed so as to magnetically couple the top core 33 to the opposing core 32. Each plunger 4 is configured to advance to and retract from the opposing core 32 and the top core 33 in the Z-direction.

The top core 33 and the bottom core 34 are coupled to each other through the first side core 36*a* and the second side core 36*b*. The first and second side cores 36*a* and 36*b* are disposed outside the two electromagnetic cores 2 in the X-direction. The magnetic resistance part 5 is formed in each of a part of the bottom core 34 between the first opposing core 32*a* and the first side core 36*a*, a part of the bottom core 34 between the second opposing core 32*b* and the second side core 36*b*, and a part of the bottom core 34 between the first opposing core 32*a* and the second opposing core 32*b*.

The shape of the plunger 4 of this embodiment differs from that of the plunger 4 of the first embodiment. In this embodiment, the magnetic body part 41 of the plunger 4 is formed in a disk shape, and is formed with the abutment part 42 projecting from the center thereof in the Z-direction. However, the plunger 4 of this embodiment is basically the same in function as that of the plunger 4 of the first embodiment.

Next, the operation of the solenoid device 1 according to the sixth embodiment is explained. The first electromagnetic coil 2*a* is energized when the two plungers 4 are not attracted to the opposing cores 32 (FIG. 16). As a result, the magnetic flux $\phi 1$ (see FIG. 17) is generated in the closed magnetic path including the first opposing core 32*a* and the first side core 36*a*.

Figure 17:
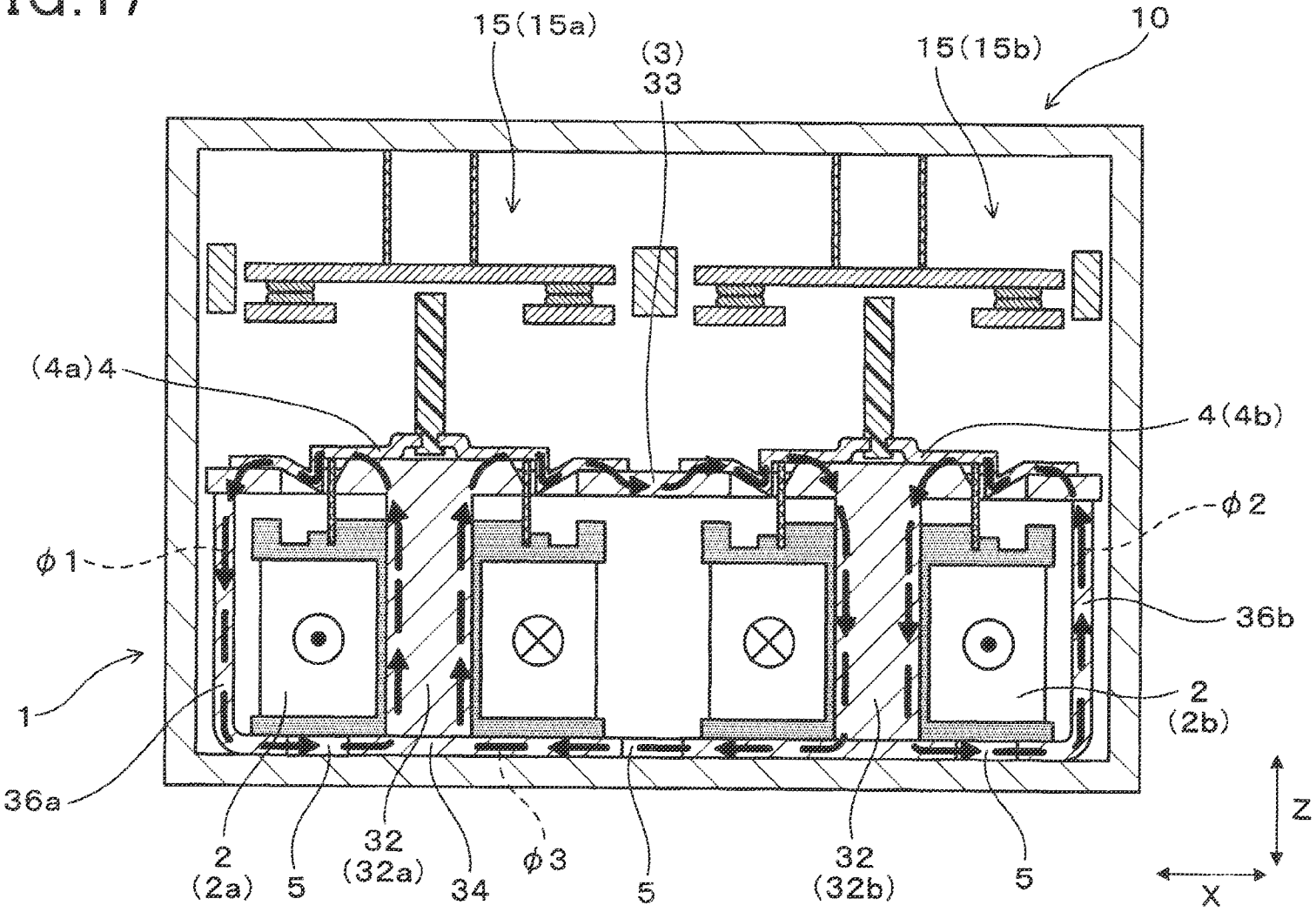
FIG. 17 is a cross-sectional view of the electromagnetic relay including the solenoid device according to the sixth embodiment brought to the multi-attracting state.

Subsequently, the second electromagnetic coil 2*b* is energized as a result of which the magnetic flux $\phi 2$ is generated in the closed magnetic path including the second plunger 4*b* and the second side core 36*b*, and the second plunger 32*b* is attracted to the second opposing core 32*b* as shown in FIG. 17. As a result, the multi-attracting state where the two plungers 4 are attracted to the opposing cores 32 is achieved. At this time, since the two plungers 4 are attracted to the fixed core 3, the magnetic resistance of the closed magnetic path including the two opposing cores 32, the bottom core 34 and the top core 33 is small. In addition, since the magnetic resistance part 5 is provided in each of the closed magnetic path including the first opposing core 32*a* and the first side core 36*a* and the closed magnetic path including the second opposing core 32*b* and the second side core 36*b*, the magnitudes of the magnetic fluxes $\phi 1$ and $\phi 2$ are limited. Hence, the magnetic flux $\phi 3$ is generated also in the closed magnetic path including the two opposing cores 32, the bottom core 34 and the top core 33.

Figure 18:
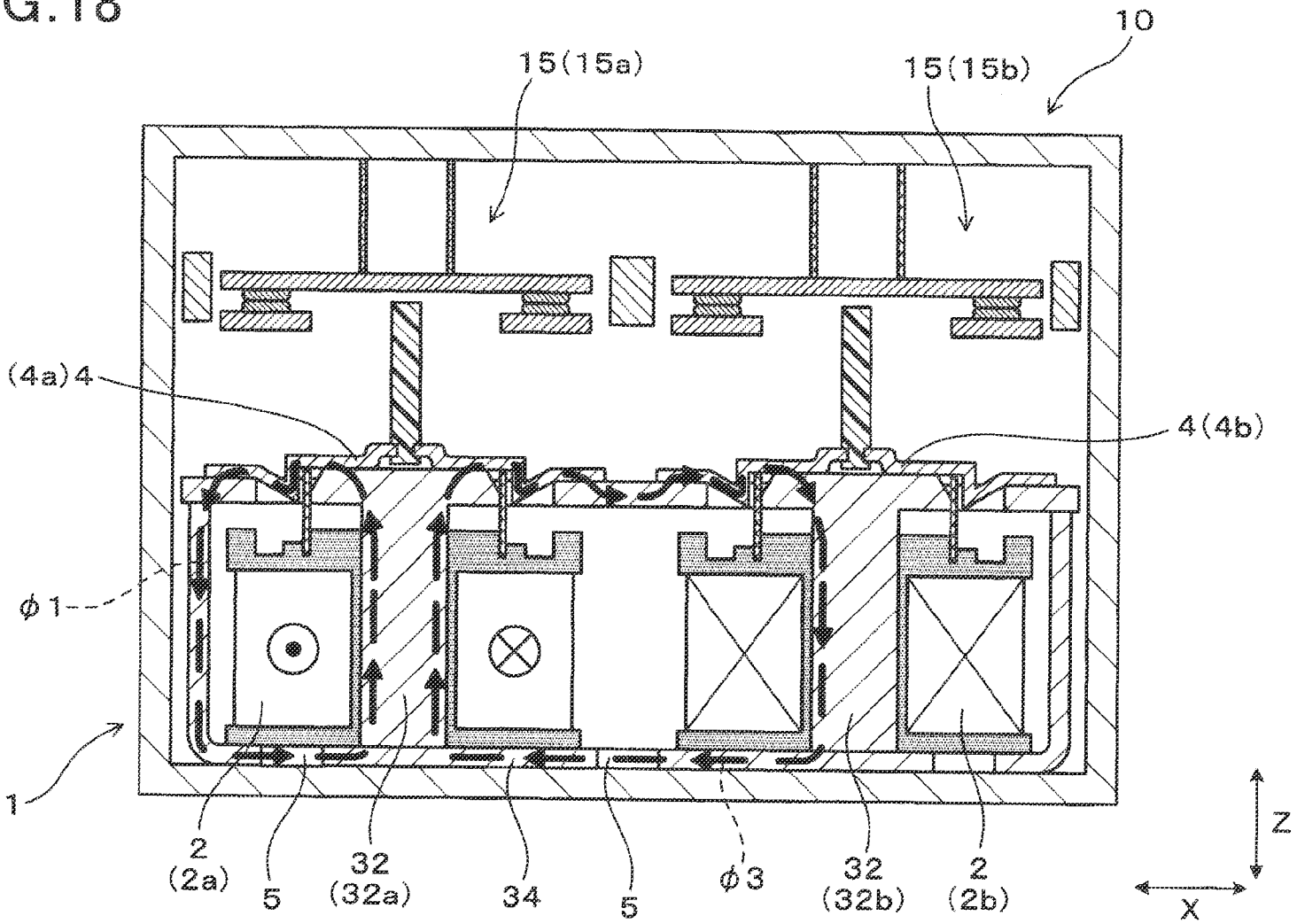
FIG. 18 is a cross-sectional view of the electromagnetic relay including the solenoid device according to the sixth embodiment maintained in the multi-attracting state.

Thereafter, to reduce the power consumption for maintaining the multi-attracting state where the two plungers 4 are attracted to the opposing cores 32, one of the first electromagnetic coils 2 (the second electromagnetic coil 2*b*, in this embodiment) is de-energized as shown in FIG. 18. The multi-attracting state can be maintained by energizing only the first electromagnetic coil 2*a*.

Other than the above, the sixth embodiment is the same in structure as the first embodiment, and provides the same advantages as those provided by the first embodiment.

Incidentally, although the magnetic resistant part 5 is provided also in a part of the bottom core 34 between the first and second opposing cores 32*a* and 32*b* in this embodiment, it may be omitted. Further, when the multi-attracting state is maintained by energization of the first electromagnetic coil 2*a*, the magnetic resistant part 5 may not be provided in the part of the bottom core 34 between the second opposing core 32*b* and the second side core 36*b*.

Seventh Embodiment

Figure 19:
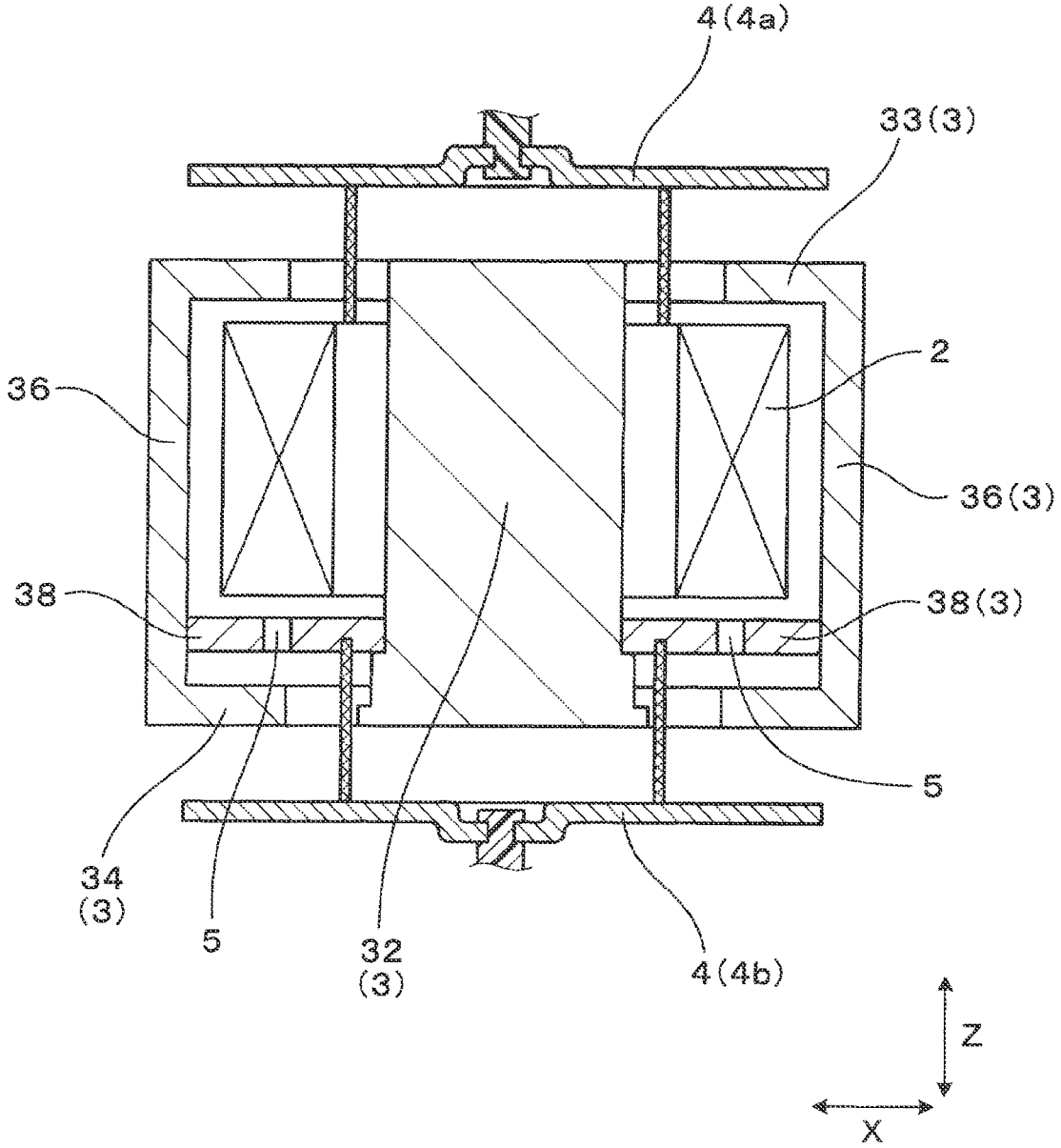
FIG. 19 is a cross-sectional view of an electromagnetic relay including a solenoid device according to a seventh embodiment of the invention.
Figure 20:
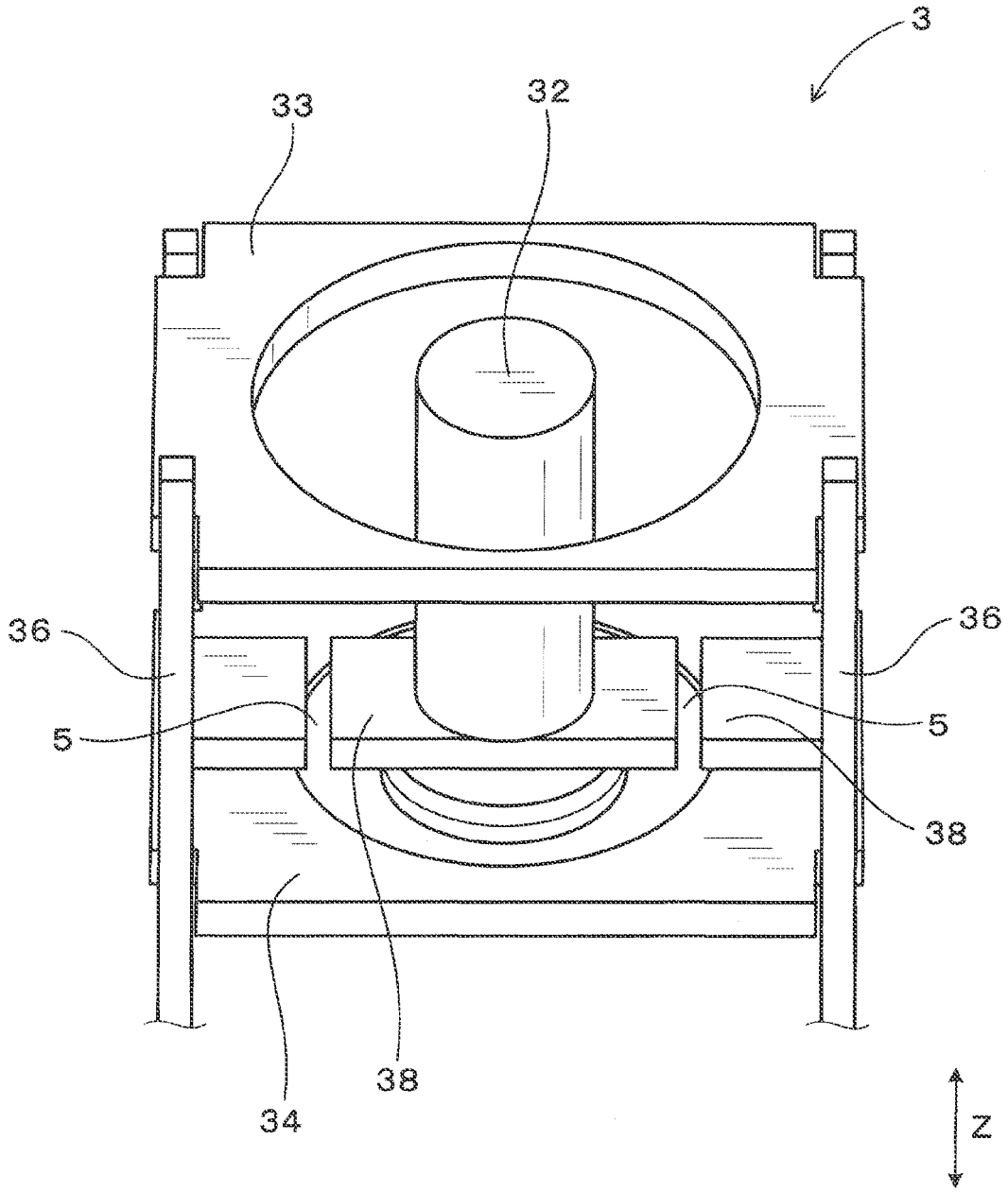
FIG. 20 is a perspective view of a fixed core of the solenoid device according to the seventh embodiment.

Next, a second embodiment of the invention is described with reference to FIGS. 19 and 20. As shown in FIGS. 19 and 20, the solenoid device 1 according to the seventh embodiment of the invention includes a single electromagnetic coil 2 and two plungers 4 (first and second plungers 4*a* and 4*b*) opposite to each other on both axial sides of the electromagnetic coil 2. The fixed core 3 includes an opposing core 32 penetrating inside the electromagnetic coil 2, two side cores 36 disposed on both sides of the electromagnetic coil 2 in the X-direction, bottom and top cores 34 and 33 magnetically coupling the side cores 35 to the plungers 4. The fixed core 3 further includes a middle core 38 disposed between the bottom core 34 and the electromagnetic core 2 in the Z-direction for magnetically coupling the side cores 36 to the opposing core 32. The magnetic resistance part 5 is formed in the middle core 38.

Next, the operation of the solenoid device 1 according to the seventh embodiment is explained. The electromagnetic coil 2 is energized when the two plungers 4 are not attracted to the opposing core 32 (FIG. 19). As a result, a magnetic flux is generated in the closed magnetic path including the opposing core 32 and the middle core 38, and the first plunger 4*a* is attracted to the opposing core 32.

In this state, the magnetic resistance of the closed magnetic path including the first and second plungers 4*a* and 4*b* and the opposing core 32 is small. At this time, since the magnetic resistance part 5 is formed in the middle core 38, the magnitude of the magnetic flux generated in the closed magnetic path including the opposing core 32, the middle core 38 and the first plunger 4*a* is limited. Accordingly, a sufficient magnetic flux is generated also in the closed magnetic path including the first and second plungers 4*a* and 4*b*. Since sufficient magnetic flux is generated in each of the above two closed magnetic paths, the multi-attracting state where the two plungers 4 are attracted to the opposing core 32 can be maintained by energizing the single electromagnetic coil 2.

Other than the above, the seventh embodiment is the same in structure as the sixth embodiment, and provides the same advantages as those provided by the sixth embodiment.

It is a matter of course that various modifications can be made to the above embodiments. For example, the second embodiment may be combined with any one of the third to seventh embodiments. The solenoid device of the invention can be used for various devices or apparatuses other than the electromagnetic relay.

The above explained preferred embodiments are exemplary of the invention of the present application which is described solely by the claims appended below. It should be understood that modifications of the preferred embodiments may be made as would occur to one of skill in the art.

What is claimed is:

1. A solenoid device comprising:

at least one electromagnetic coil for generating a magnetic flux when energized;

a fixed core constituting part of a magnetic circuit through which the magnetic flux passes, the fixed core being comprised of a center core, two opposing cores, two top cores and two bottom cores; and plungers constituting the magnetic circuit together with the fixed core and configured to advance to and retract from the fixed core depending on whether the electromagnetic coil is energized or de-energized;

the magnetic circuit being provided with a magnetic resistance part as a resistance for the magnetic flux, the magnetic resistance part is formed in each of the bottom cores of the fixed core;

the plungers being configured to be attracted to the fixed core by energizing the electromagnetic coil.

2. The solenoid device according to claim 1, wherein a multi-attracting state where the plungers are attracted to the fixed core is maintained while the electromagnetic coil is energized.

3. The solenoid device according to claim 1, wherein the plungers are magnetically parallel-connected through the fixed core.

4. The solenoid device according to claim 1, wherein the magnetic resistance part is formed by a gap dividing the fixed core in a direction of the magnetic circuit.

5. The solenoid device according to claim 4, wherein a low magnetic permeability member whose magnetic permeability is lower than that of the fixed core is disposed in the gap.

6. The solenoid device according to claim 1, wherein the electromagnetic coil is disposed at a plurality of locations.

* * * * *